US010246286B2

(12) United States Patent
Erkelenz

(10) Patent No.: US 10,246,286 B2
(45) Date of Patent: Apr. 2, 2019

(54) CONVEYOR FOR WEB

(71) Applicant: VITS TECHNOLOGY GmbH, Langenfeld (DE)

(72) Inventor: Willi Erkelenz, Langenfeld (DE)

(73) Assignee: VITS TECHNOLOGY GMBH, Langenfeld (DE)

( * ) Notice: Subject to any disclaimer, the term of this patent is extended or adjusted under 35 U.S.C. 154(b) by 0 days.

(21) Appl. No.: 15/557,079

(22) PCT Filed: Apr. 14, 2016

(86) PCT No.: PCT/EP2016/058172
§ 371 (c)(1),
(2) Date: Sep. 9, 2017

(87) PCT Pub. No.: WO2016/173850
PCT Pub. Date: Nov. 3, 2016

(65) Prior Publication Data

US 2018/0065824 A1 Mar. 8, 2018

(30) Foreign Application Priority Data

Apr. 30, 2015 (DE) ..... 10 2015 106 747

(51) Int. Cl.
*B65H 20/16* (2006.01)
*D21H 23/32* (2006.01)
*D21H 23/70* (2006.01)

(52) U.S. Cl.
CPC ..... *B65H 20/16* (2013.01); *D21H 23/32* (2013.01); *D21H 23/70* (2013.01); *B65H 2301/44332* (2013.01); *B65H 2301/52202* (2013.01)

(58) Field of Classification Search
None
See application file for complete search history.

(56) References Cited

U.S. PATENT DOCUMENTS 2,936,171 A * 5/1960 Williams ..... B65H 3/0816 271/12
6,343,424 B1 * 2/2002 Erkelenz ..... B65H 19/22 242/527
2004/0122391 A1 * 6/2004 Franklin ..... A61F 13/15772 604/367

* cited by examiner

*Primary Examiner* — Jethro M. Pence
(74) *Attorney, Agent, or Firm* — Andrew Wilford

(57) ABSTRACT

The invention relates to a transport device (10) for a beginning or an end of a web, comprising at least one driver (27) for a beginning or an end of a web (1). The transport device (10) is largely guided on a horizontal plane from a front region to a rear region of a system. The transport device (10) is to be improved such that smaller quantities of impregnated decorative paper can be produced with little complexity and minimum waste. For this purpose, the driver (27) comprises a plate-shaped magnet (22) which is guided below the web (1) during the operation of the transport device (10), extends over at least the width of the web (1), and interacts with a magnetizable sheet-metal plate (23) during the operation of the transport device (10), said sheet-metal plate being movable above the web (1) from a rest position into a holding position.

9 Claims, 2 Drawing Sheets

Fig. 3
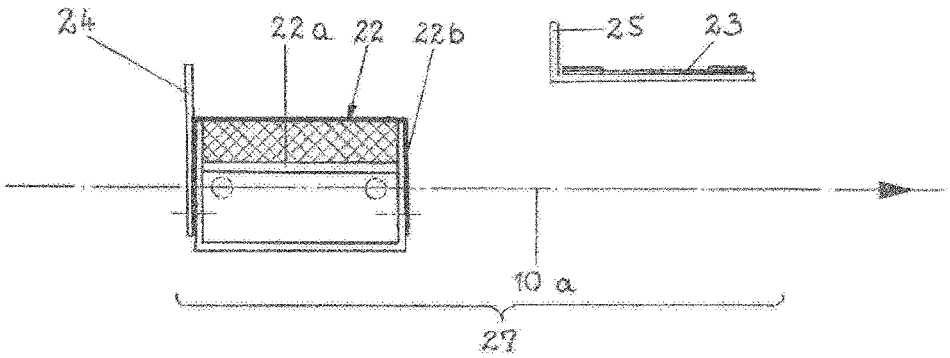
Fig. 4
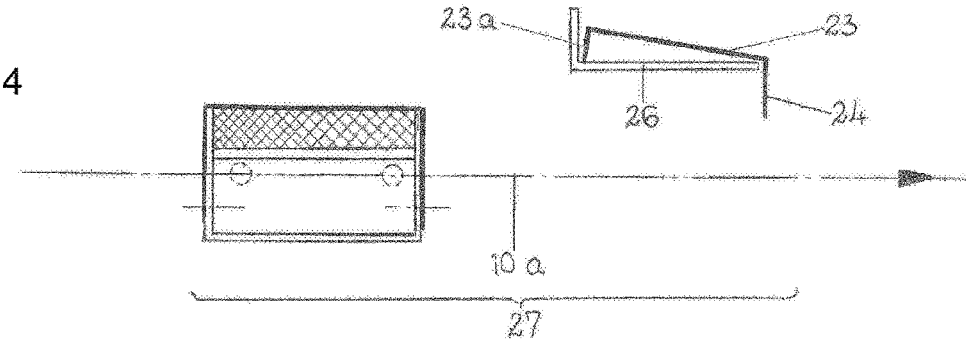
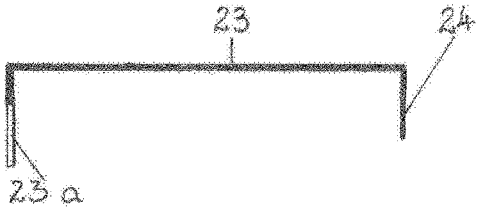
Fig. 5A
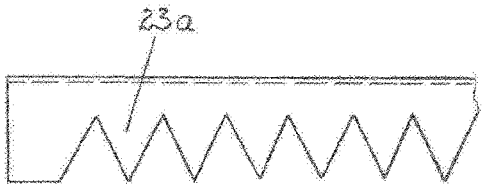
Fig. 5B
Fig. 6
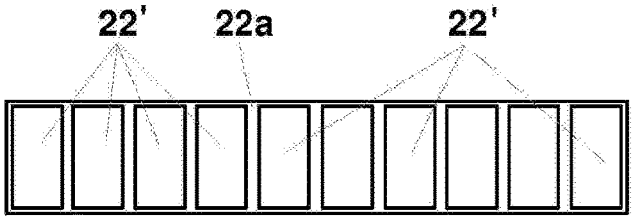

CONVEYOR FOR WEB

CROSS REFERENCE TO RELATED APPLICATIONS

This application is the US-national stage of PCT application PCT/EP2016/058172 filed 14 Apr. 2016 and claiming the priority of German patent application 102015106747.1 itself filed 30 Apr. 2015.

FIELD OF THE INVENTION

The invention relates to a conveyor for a web with at least one attachment for a leading end or a trailing end of the web, the conveyor extending generally along on a horizontal plane from an upstream portion to a downstream region of a system. Such a conveyor is provided, for example, in an apparatus for impregnating a material web or in a printer.

BACKGROUND OF THE INVENTION

In the furniture industry and for laminate floor panels, decorative papers are used for visible surfaces of wood or fiberboard panels. For this purpose, a printed paper web is impregnated with synthetic resins such as urea resin or melamine and optionally provided with abrasion-resistant particles such as corundum, for example, in order to impart certain characteristics to the web. The web is subsequently dried and cooled. Unprinted paper, i.e. paper without decorative elements, is also used in part. An apparatus and method for making an impregnated web (impregnates) is known from the prior art and described, for example, in DE 20 2007 011 437 and DE 197 10 549.

Manufacturers of furniture and/or laminates are taking measures to drastically reduce their warehoused stock. This means that they order relatively small quantities of a given decorative element that is to be delivered on a certain date.

The impregnation and coating of paper webs is very elaborate when using the known methods and systems. In particular, the production of rejects during start-up and shut-down of the devices, as well as the effort involved, are very high. To wit, the web must first be threaded by hand into an impregnation station and optionally through impregnation baths. The web is impregnated and discarded until an adequate impregnation outcome is achieved. Only then is the web cut, and the new leading end of the web extends from an intake device through a dryer and a cooler. Rejects also occur downstream of these devices initially until a satisfactory final web quality has been achieved. It is only then that the production of usable impregnate is begun, and it is cut into sheets or spooled. Where necessary, the desired impregnation/coating agents must be gathered and exchanged for those already present in the system. Relatively large quantities of about 800 l of resin are required for this. The setup time for preparation takes more than an hour. All things considered, the costs of labor and rejects during startup and shutdown are therefore high. For this reason, impregnation operations are not able to economically produce small quantities of impregnated goods and are forced to reject such orders or fill them at a loss. The speed of the web during threading and drawing-in are much slower than the production speed.

One approach to solving the above-described problem is described in DE 10 2009 021 164. There, it is proposed that an intake device for a web be moved generally along a horizontal plane from a region upstream of an impregnation station to downstream of a cooler.

In terms of the invention, the term "impregnation station" refers to the application of resin to a web, independently of the type of application used, for example dipping, spraying, or coating, and of the function, whether the resin is being applied for the purpose of impregnation or coating (for example of a pretreated web). The term "impregnation" is used generically.

OBJECT OF THE INVENTION

It is the object of the invention to improve a conveyor for a leading end or a trailing end of a web such that smaller quantities of impregnated decorative paper can be manufactured with little effort and minimum waste.

SUMMARY OF THE INVENTION

The object is attained in that the attachment comprises a bar magnet that extends during the operation of the conveyor below the web, extends over at least the width of the web, and cooperates with a magnetizable sheet-metal plate that can be moved above the web out of a holder into a holding position.

For one, this enables the web to be drawn automatically into the complete device. All that needs to be made available is a sufficiently long leading end of the web that hangs freely from a supply roll. The leading end is then clamped between the magnet and the sheet-metal plate and can be pulled through the conveyor to downstream of the cross-cutter. Moreover, once the required production quantity has been reached, one end of the web can be moved downstream of the dryer by the conveyor. Beforehand, for example during the operation of the device, the magnet and the sheet-metal plate must be brought into their second starting positions. The work involved for operation is further reduced. All in all, the web can be largely be treated and used in its entirety. The production of rejects is avoided almost completely, thus enabling even smaller quantities of impregnate to be produced in an economical manner. The device can be operated by one person.

In one embodiment, the magnet is formed by a plurality of individual plates. This renders the magnet less mechanically sensitive, more economically obtainable, and easier to install in the device.

In another embodiment, the magnet is supported in a housing that has at least one first pair of pickers for the sheet-metal plate. The housing is preferably made of non-magnetizable material, protects the mechanically sensitive magnet from breakage, for example, and ensures the usual functioning even in case of breakage. In particular, the individual plates can be arranged securely and in a predefined position.

In another embodiment, a second pair of pickers is provided on the sheet-metal plate. This enables differently designed sheet-metal plates to be selectively taken off.

In another embodiment, the magnet is provided with a cover made of non-magnetizable material. The magnet is thus protected from the impacting sheet-metal plate, thereby ensuring the durability of the magnet without interfering with the magnetic field.

In another embodiment, the conveyor is provided in a system for impregnating the web. The conveyor is especially well suited for this purpose.

In another embodiment, a first holder is provided in a region between an unwinder and an impregnation station, and a second holder is provided between the impregnation station and a dryer. On the one hand, this enables a leading end of the web to be pulled in reliably and automatically through the complete impregnation station and, on the other hand, a trailing end of the impregnated web to be guided to a cross-cutter, resulting in an especially small amount of waste.

In another embodiment, a second sheet-metal plate that is provided for the second holder has a cutter for the web. The required separation of the web is thus performed automatically.

In another embodiment, a pusher for pressing the sheet-metal plate onto the magnet is associated with the second holder. This ensures the secure severing even of more stable webs.

BRIEF DESCRIPTION OF THE DRAWING

The invention will be explained in further detail using the example of an impregnation station and with reference to the schematic drawing in which:

FIG. 3 is a portion of a conveyor for a leading end of a web;

FIG. 4 is an alternative of the conveyor;

FIGS. 5A and 5*b* are views of a metal sheet serving as a cutter for the web; and FIG. 6 is a view of a magnet made of a plurality of plates.

SPECIFIC DESCRIPTION OF THE INVENTION

Figure 1:
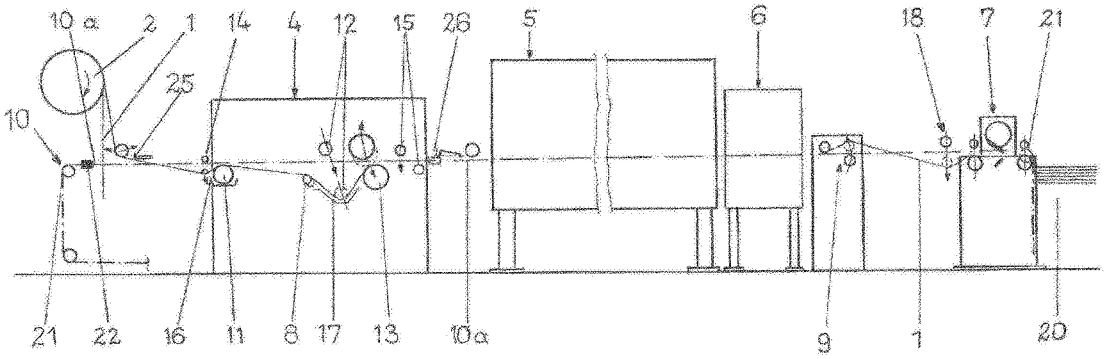
FIG. 1 is a schematic longitudinal section through a device according to the invention.
Figure 2:
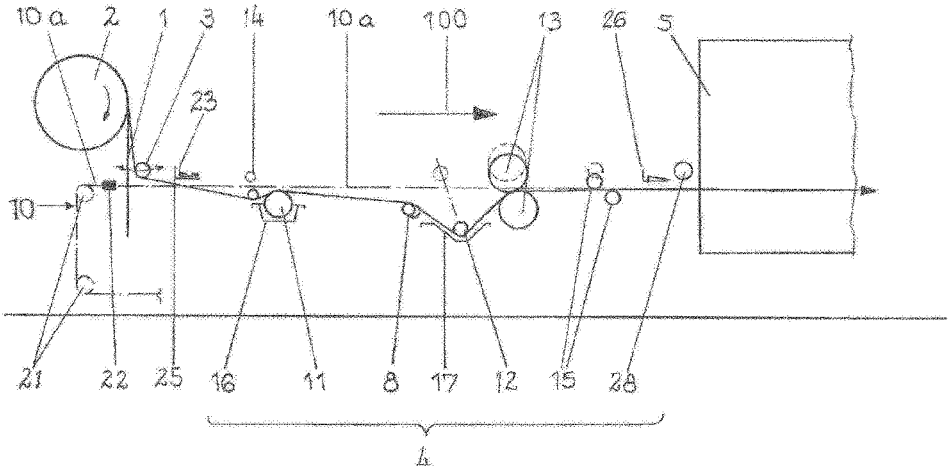
FIG. 2 is detail of an upstream portion of the schematic view of FIG. 1.

According to FIGS. 1 and 2, a web 1 of paper extends in a web travel direction 100 through an impregnating/coating device in which it passes from a supply roll 2 successively through an impregnation station 4, a drying station or dryer 5, a cooling station or cooler 6, and a cross-cutting station or cross-cutter 7. The impregnating/coating device further comprises an expander roller 8, web control rollers 9, and a conveyor 10.

In the present application, directional information such as upstream or downstream refers to the web travel direction 100.

In an unillustrated embodiment, the supply roll 2 that holds a quantity of the web 1 is rotatable in an unwinder such that the web 1 can be pulled off it. The supply roll 2 is either drivable, in which case the web 1 is deflected over a roller 3, or an intake station or means is provided between the supply roll 2 and the impregnation station 4 that comprises several rollers of which at least one is drivable.

The impregnation station 4 comprises an applicator roller 11 with a first deflection roller 14, an immersion roller 12, two metering rollers 13, and two distributing rollers 15. The applicator roller 11, the immersion roller 12, the metering rollers 13, the first deflection roller 14, and the distributing rollers 15 extend parallel to one another.

The applicator roller 11 is drivable and supported in a first trough 16 such that it projects with approximately half of its outer surface upward out of the first trough 16. During operation, the first trough 16 is filled to a predetermined level with impregnating agent, so that a portion of the outer surface of the applicator roller 11 dips into the impregnating agent. The first deflection roller 14 is mounted in a vertically displaceable manner at a short spacing upstream of the applicator roller 11.

The immersion roller 12 is mounted at a predetermined spacing downstream of the applicator roller 11 so as to be displaceable vertically or approximately vertically into an upper loading position or into a lower immersion position in a second trough 17. The expander roller 8 is mounted upstream of and above the second trough 17 such that it is contacted by the web 1 in its upper apex region during operation. During operation, the second trough 17 is filled with a second impregnating agent that can be different from the impregnating agent in the first trough 16, and the immersion roller 12 dips at least partially into the second impregnating agent. The web 1 wraps partially around the immersion roller 12 in a lower region.

Downstream of and above the immersion roller 12, two metering rollers 13 are mounted such that they form a narrow, width-adjustable gap. One of the metering rollers 13 is vertically displaceable for this purpose.

The distributing rollers 15 are mounted downstream of the metering rollers 13, with an upstream distributing roller 15 being displaceable perpendicular to the web travel direction.

After a predefined transport through a distance of 1 m, for example, downstream of the impregnation station 4, the web 1 passes into the dryer 5 where energy can be applied to it in a known manner, preferably in the form of heat.

The cooler 6 and then the web control rollers 9 are provided downstream of the dryer 5 in order to regulate the directional stability of the web 1. One of the rear web control rollers 9 can pivot as indicated by the double-headed arrow.

At the downstream end there is the cross-cutter 7 with an upstream second deflection roller 18 and a sheet stacker 20 for the sheets cut from the web 1. The second deflection roller 18 is supported so as to be vertically adjustable.

According to this embodiment, the first deflection roller 14, the front distributing roller 15, the immersion roller 12, the rear web passage control roller 9, and the second deflection roller 18 are referred to collectively as displaceable elements.

It will readily be understood that all of the rollers, with the exception of the web passage control rollers 9, are parallel to one another and to the plane of the web 1.

The conveyor 10 extends through the entire impregnating apparatus. It comprises two endless guide members, such as for example chains or punched steel belts, as well as a magnet 22 and a magnetizable sheet-metal plate 23 that together form an attachment 27. The guide members extend parallel and in a straight line from a region below the supply roll 2 to downstream of the cross-cutter 7, are deflected there, and thence return back to the upstream end. For guiding the guide members, rails and deflection rollers 21 for example, are provided such that an upper stretch or reach 10*a* of the conveyor 10 extends in a substantially horizontal plane. At least one of the deflection rollers 21 per guide member is drivable. The direction of transport 100 of the conveyor 10 corresponds to that of the web 1.

A bar magnet 22 is associated with the guide members and can be seen more clearly in FIGS. 3 and 4. The magnet 22 is mounted in a housing 22*a* that surrounds it. For this purpose, the housing 22*a* has (inherently known) mounting fittings on its ends at the guide members. The parallelepipedal magnet 22 is hung to extend between the guide members over somewhat more that the maximum process width of the web 1, that is, parallel to the plane of the web 1 and transverse to the direction 100 of transport. The housing 22*a* is dimensioned such that it hugs the magnet 22 with little clearance. The housing 22*a* is a U-section receptacle that can be closed by a cover 22*b*. The housing 22*a* and the cover 22*b* are made for example of a nonmagnetic material such as austenitic steel or plastic. A first pair of pickers 24 is fastened to a rear end of the housing 22*a* and therefore indirectly to the rear longitudinal side of the magnet 22 outside the width of the web 1 such that upper ends of the pickers project substantially above the cover 22*b*.

In an alternative embodiment, the first pair of pickers 24 is fastened to ends of an upstream longitudinal side of the sheet-metal plate 23. The pickers 24 point downward when the sheet-metal plate is fitted into one of the holders 25, 26.

A first holder of the magnet 22 is below the supply roll 2, and a second holder thereof is between the rear distributing roller 15 and the dryer 5.

In an alternative shown in FIG. 6, the magnet 22 is formed by a plurality of magnetic plates 22' that jointly form the magnet 22.

The sheet-metal plate 23 is made of magnetizable material such as a suitable steel, for example. Its length and width correspond substantially to the dimensions of the magnet 22.

In a first embodiment shown in FIG. 3, longitudinal edges of the sheet-metal plate 23 are rounded, for example by grinding or by bending an edge over 180°. In this way, the risk of the web 1 being damaged or even severed by the longitudinal edges is avoided. The sheet-metal plate 23 is longer than a width of the web 1, so that a predefined overhang of the sheet-metal plate 23 over the width of the web 1 is ensured at both ends.

In a second embodiment shown in FIGS. 4 and 5, the sheet-metal plate 23 is formed as a cutter for the web 1. For this purpose, a longitudinal strip 23*a* of the sheet-metal plate 23 is bent over by 90° like an angle profile. A free edge of the longitudinal strip 23*a* is formed either as a cutting edge or is preferably serrated with teeth. According to the above-described alternative of the first pair, a respective picker 24 is formed on or attached to each broad side of the sheet-metal plate 23 in the region of the longitudinal side of the sheet-metal plate 23 that lies opposite the longitudinal strip 23*a*. The two pickers 24 form here a second pair.

For the sheet-metal plate 23, the two holders 25 and 26 are provided in the impregnating apparatus that define the holders of the sheet-metal plate. The holders 25 and 26 are fastened at a short spacing above the plane on which the web 1 extends. A spacing between the plane and a lowermost side of the holders 25, 26 is 2 cm to 10 cm, for example. Each of the holders 25, 26 is made of an angle profile, for example, whose short leg at a rear end of the angle profile points upward perpendicularly or inclined slightly forward; the long leg is thus either horizontal or sloped downward slightly in the direction of transport at an angle of up to 3°.

The first holder 25 is provided between the supply roll 2 and the impregnation station 4.

The second holder 26 is fastened between the impregnation station 4 and the dryer 5. The second holder 25 of the magnet 22 is thus located between the impregnation station 4 and the second holder 26.

Pushers 28 can be provided between the second holder 26 and the dryer 5. These are composed, for example, of a roller or of at least two spaced-apart rollers. Preferably, an outer surface of the roller or rollers is coated at least over a predetermined width with an elastic coating. A lowermost side of the roller or rollers has a spacing of 2 mm to 8 mm to the plane of the web 1.

In order to put the impregnating apparatus into operation, the troughs 16 and 17 are filled with liquid resin. A leading end of the web 1 is drawn off the supply roll 2 so far that it can be guided at least to the downstream side of the first holder 25. The leading end hangs freely down from the supply roll 2. The first embodiment of the sheet-metal plate 23 is placed into the first holder 25, with the bent-over flange pointing upward.

The displaceable rollers are in an intake position. For this purpose, the downstream web passage control rollers 9 are moved into a lower position and the furthest upstream deflection roller 14, the upstream distributing roller 15, the immersion roller 12, the upper metering roller 13, and the second deflection roller 18 are each moved into an upper position. The loading positions of the rollers and a path of the web 1 that deviates from normal operation are shown with broken lines.

All of the drivable rollers are started up at a rotational speed that corresponds to the production speed, with the applicator roller 11 here being rotated in the opposite direction. The dryer 5 and the cooler 6 are put into operation and set to the required temperatures. As soon as those temperatures are reached, a drive of the conveyor 10 and a drive of the supply roll 2 and/or of the loading station are switched on at production speed, thereby moving the magnet 22 that is clamped in the guide members in the direction of transport. The magnet 22 entrains the hanging leading end of the web 1. As soon as the magnet 22 is below the first holder 25, the pickers 24 engage the sheet-metal plate 23, so that it slides onto the cover 22*b* of the magnet 22 and is held there by the magnetic force. The leading end of the web 1 is immovably clamped between the sheet-metal plate 23 and the cover 22*b*, so that it is pulled through the impregnating apparatus. The web 1 is unwound from the supply roll 2 and guided around the roller 3, with the web 1 under a predefined tension.

After the magnet 22 has passed the applicator roller 11, the first deflection roller 14 is moved into the lower position, so that the web contacts a portion of the outer surface of the applicator roller 11 and is thus wetted with the liquid impregnating agent from the trough 16.

The magnet 22 with the leading end of the web 1 travels further above the expander roller 8 and between the distributing rollers 15. As soon as it has passed through the latter, the immersion roller 12, the upper metering roller 13, and the front distributing roller 15 are moved into their lower positions.

The magnet 22 and thus the web 1 passes further through the dryer 5, where the web 1 is dried to a predefined residual moisture. Heat is preferably used as the drying energy, for example in the form of hot air or infrared radiation, but other energy sources such as microwaves, for example, can also be employed. The web 1 is then cooled in the cooler 6. Moreover, after the magnet 22 passes through, the downstream web passage control roller 9 is moved upward and the web passage control switched on.

The web 1 is then guided under the second deflection roller 18 that, after the passing of the magnet 22, is moved into its lower position, to the cross-cutter 7, where it is cut into sheets having a predefined length, and the sheets are placed in the sheet stacker 20. As soon as the magnet 22 has reached the downstream end of the sheet stacker 20, the drive of the conveyor 10 is switched off, and normal operation continues. The loading speed and the production speed are substantially the same and are 0.5 to 20 m/min.

In order to shut the impregnating apparatus down, the magnet 22 is first hung in a location between the distributing roller 15 and the dryer 5 such that it is located upstream of the second holder 26 with the sheet-metal plate 23. The conveyor 10 is switched on at production speed, so that the magnet 22 is transported toward the dryer 5. The magnet 22 removes the sheet-metal plate 23 with the second pair of pickers 24. The sheet-metal plate 23 is held by the magnet 22, so that the web 1 is clamped here between the magnet 22 and the sheet-metal plate 23. At the same time, the web 1 is severed just upstream of the magnet 22 by the longitudinal strip 23*a*, optionally with the aid of the pusher 28, thereby creating a new leading end of the web 1 as well as a web end that is transported further. The unwinder or the loading station and the impregnation station 4 are stopped, and the associated displaceable elements are moved into their loading positions.

The web end extends through the dryer 5 and farther until just upstream of the sheet stacker 20, so that the web 1 is processed completely to the web end. The web 1 can thus be utilized without substantial waste. The conveyor 10, the dryer 5, the web tension control 9, the cooler 6, and the cross-cutter are stopped. Just upstream of the trailing web end, a displaceable element is reached that is moved into its loading position.

Unusable remnants of the web 1 are removed and, if necessary, the impregnating/coating device is emptied and cleaned. It is then available for the impregnation of a new web 1.

The invention claimed is:

1. A system having a plurality of treatment stations arrayed along a horizontal treatment path, the system comprising:

a conveyor having a guide extending horizontally and displaceable in a direction through the stations from an upstream end to a downstream end of the path;

intake means for feeding an end of a web to the upstream end of the path;

a bar magnet carried on the conveyor and extending a full width of the web;

a first holder above the path adjacent the upstream end;

a magnetizable metal plate in the first holder, whereby movement of the conveyor displaces the bar magnet underneath the web at the first holder and attracts the magnetizable metal plate; and a picker on the bar magnet configured to engage with the magnetizable metal plate on advancement of the bar magnet past the magnetizable metal plate, and sweep the magnetizable metal plate off the first holder onto the web and thereby magnetically press the web with the magnetizable metal plate against the guide and entrain the web with the conveyor.

2. The system defined in claim 1, wherein the bar magnet comprises a plurality of individual plates.

3. The system defined in claim 1, further comprising: a housing that holds the bar magnet and the picker for the magnetizable metal plate.

4. The system defined in claim 3, further comprising: a second pair of pickers is provided on the magnetizable metal plate.

5. The system defined in claim 1, wherein the bar magnet is provided with a cover made of a non-magnetizable material.

6. The system defined in claim 1, wherein the treatment stations include an unwinder for a supply roll of the web, at least one impregnation station, at least one dryer, and at least one cooler.

7. The system defined in claim 6, wherein the first holder for the magnetizable metal plate is provided between the unwinder and the at least one impregnation station, the system further comprising: a second holder provided between the at least one impregnation station and the at least one dryer.

8. The system defined in claim 7, further comprising: a second magnetizable metal plate provided for the second holder and forming a cutter for the web.

9. The system defined in claim 8, further comprising: a pusher for pressing the second magnetizable metal plate against the bar magnet and associated with the second holder.

* * * * *